US005911208A

United States Patent [19]

Furusawa et al.

[11] Patent Number: 5,911,208

[45] Date of Patent: Jun. 15, 1999

[54] HIGH-PRESSURE FUEL SUPPLY DEVICE FOR INTERNAL COMBUSTION ENGINE

[75] Inventors: Shinya Furusawa, Okazaki; Eiji Hashimoto, Susono, both of Japan

[73] Assignee: Toyota Jidosha Kabushiki Kaisha, Toyota, Japan

[21] Appl. No.: 08/951,487

[22] Filed: Oct. 16, 1997

[30] Foreign Application Priority Data

Nov. 25, 1996 [JP] Japan ..... 8-313705

[51] Int. Cl.[6] ..... F02M 37/04

[52] U.S. Cl. ..... 123/506; 123/456; 92/86

[58] Field of Search ..... 123/456, 446, 123/468, 497, 506; 92/86

[56] References Cited

U.S. PATENT DOCUMENTS

| | | | |
|---|---|---|---|
| 3,212,448 | 10/1965 | Johnston | 92/86 |
| 3,742,822 | 7/1973 | Talbert | 92/86 |
| 4,510,908 | 4/1985 | Fisele | 123/506 |
| 4,776,260 | 10/1988 | Vingze | 92/86 |
| 5,125,807 | 6/1992 | Kohler | 123/506 |
| 5,230,613 | 7/1993 | Hilsbos | 123/456 |
| 5,273,017 | 12/1993 | Braun | 123/506 |
| 5,313,924 | 5/1994 | Regueiro | 123/456 |
| 5,404,855 | 4/1995 | Yen | 123/456 |
| 5,537,980 | 7/1996 | Yamamoto | 123/456 |

FOREIGN PATENT DOCUMENTS

| | | |
|---|---|---|
| A-01073166 | 3/1989 | Japan . |
| A-2-146256 | 6/1990 | Japan . |
| A-06249100 | 9/1994 | Japan . |

*Primary Examiner*—Carl S. Miller
*Attorney, Agent, or Firm*—Oliff & Berridge, PLC

[57] ABSTRACT

The high-pressure fuel supply device for an internal combustion engine for pressurizing fuel to a high pressure and supplying the pressurized fuel to the internal combustion engine. The device includes: a fuel pressure chamber defined by a cylinder and a plunger disposed in the cylinder so as to reciprocate in the cylinder; a fuel flow passage for pumping out fuel from a fuel tank with a pump and sending the pumped fuel to the fuel pressure chamber; a check valve disposed in the fuel flow passage for permitting flow of the fuel only to the fuel pressure chamber; a fuel supply passage associating the fuel pressure chamber with the internal combustion engine for pressing the fuel in the fuel pressure chamber pressurized by reciprocation of the plunger into the internal combustion engine; a fuel spill passage associating the fuel pressure chamber with the fuel tank; and a fuel spill valve disposed in the fuel spill passage for changing a spill amount of fuel to be returned to the fuel tank by opening and closing the fuel spill valve, so as to regulate an amount of fuel to be pressed to flow from the fuel pressure chamber to the internal combustion engine.

3 Claims, 4 Drawing Sheets

HIGH-PRESSURE FUEL SUPPLY DEVICE FOR INTERNAL COMBUSTION ENGINE

BACKGROUND OF THE INVENTION

1. Field of the Invention

The present invention relates to a device for supplying high-pressure fuel to an internal combustion engine. More particularly, the invention relates to a high-pressure fuel supply device which regulates the amount of fuel to be supplied to an internal combustion engine with a fuel spill valve.

2. Description of the Related Art

A device for supplying high-pressure fuel to an internal combustion engine generally includes a pressure chamber which pressurizes fuel to be supplied to the internal combustion engine and a spill valve which regulates the amount of fuel to be supplied to the internal combustion engine by changing the amount of fuel spilling from the pressure chamber (see, for example, Japanese Laid-Open Publication No. 2-146256 titled "Variable discharge high-pressure pump").

FIG. 7 shows an example of such a conventional high-pressure fuel supply device. Referring to FIG. 7, a high-pressure fuel supply device 100 includes a cylinder 101, a plunger 102 disposed in the cylinder 101 so as to reciprocate therein, and a plunger chamber 103 defined by the cylinder 101 and the plunger 102. The plunger 102 moves upward and downward in response to the rotation of a crank shaft (not shown) of an internal combustion engine 115.

A spill passage 104 which is open to the plunger chamber 103 is formed in the cylinder 101. An opening 104*a* of the spill passage 104 is opened and closed by a valve body 105*a* of a solenoid valve 105 disposed on the cylinder 101 (shown in the upper part of FIG. 7). The activation of the solenoid valve 105 is controlled by an electronic control device (not shown) of the internal combustion engine 115.

The spill passage 104 is associated with a fuel tank 109 via an introduction bore 106, a fuel reservoir 107, and a supply pump 108. The supply pump 108 pumps fuel out from the fuel tank 109 toward the plunger chamber 103. The plunger chamber 103 is also associated with a common rail 112 via a high-pressure fuel passage 110 provided with a check valve 111. The common rail 112 is provided with a plurality of injectors 113 corresponding to respective cylinders of the internal combustion engine 115, so that fuel in the common rail 112 is injected from the injectors 113 into combustion chambers of the corresponding cylinders.

The fuel reservoir 107 is also associated with the fuel tank 109 via a relief passage 116. The relief passage 116 is provided with a pressure adjusting valve 117. When the pressure of the fuel in the fuel reservoir 107 increases to a predetermined value or more, the pressure adjusting valve 117 opens to allow fuel in the fuel reservoir 107 to flow back to the fuel tank 109.

In the device 100 with the above configuration, when the plunger 102 moves downward in the cylinder 101 while the solenoid valve 105 is open, fuel pumped by the supply pump 108 is allowed to enter the plunger chamber 103 via the spill passage 104. In the case where the solenoid valve 105 is kept open, as the plunger 102 moves upward, the fuel in the plunger chamber 103 spills therefrom to flow back to the fuel reservoir 107 via the spill passage 104 and the like. In this case, therefore, the fuel in the plunger chamber 103 is not pressurized.

On the contrary, in the case where the solenoid valve 105 is closed after the fuel is introduced into the plunger chamber 103, the fuel is pressurized as the plunger 102 moves upward. When the pressure of the fuel in the plunger chamber 103 increases to a predetermined value at which the check valve 111 opens or more, the check valve 111 opens to allow the fuel to be pressed to flow into the common rail 112 via the high-pressure fuel passage 110.

In the device 100 with the above operation, the amount of fuel pressed to flow from the plunger chamber 103 to the common rail 112 can be regulated by changing the time when the solenoid valve 105 is closed. For example, when the solenoid valve 105 is closed simultaneously with the start of the upward movement of the plunger 102, all the fuel existing in the plunger chamber 103 is pressurized and discharged, resulting in the maximum fuel discharge amount from the device to the common rail 112. On the contrary, when the solenoid valve 105 is kept open even after the start of the upward movement of the plunger 102, part of the fuel existing in the plunger chamber 103 spills out to the spill passage 104 to be returned to the fuel tank 109. Then, by closing the solenoid valve 105 during the upward movement of the plunger 102, the remaining fuel in the plunger chamber 103 is pressurized and discharged to the common rail 112. In other words, the fuel discharge amount can be regulated by controlling the duration from the start of the upward movement of the plunger 102 until the time when the solenoid valve 105 is closed.

Alternatively, the solenoid valve 105 may be closed simultaneously with the start of the upward movement of the plunger 102 and then opened during the upward movement of the plunger 102. By changing the time when the solenoid valve 105 is opened, the fuel discharge amount can be changed.

The device 100 therefore makes it possible to keep the pressure of the fuel in the common rail 112 at a predetermined value by changing the time when the solenoid valve 105 is opened or closed so as to change the fuel discharge amount.

However, the above high-pressure supply device 100 has the following problems. When fuel in the plunger chamber 103 is to be pressurized, the solenoid valve 105 needs to be in the closed state in response to a close signal from the electronic control device. However, a response lag exists from the time when the close signal is output from the electronic control device until the time when the solenoid valve 105 has actually been closed. In the case of securing the maximum discharge amount from the device 100, therefore, the close signal must be output to the solenoid valve 105 earlier in consideration of this response lag, so as to ensure that the solenoid valve 105 has been closed when the plunger 102 starts moving upward. If the solenoid valve 105 has not been closed when the plunger 102 is moving upward from the bottom dead center, the fuel in the plunger chamber 103 will spill out via the spill passage 104.

In order to accomplish the above, the solenoid valve 105 should be closed before the plunger 102 reaches the bottom dead center. In this case, however, the spill passage 104 starts closing while fuel should still be introduced into the plunger chamber 103 via the spill passage 104. As a result, the conventional device 100 fails to introduce into the plunger chamber 103 a sufficient amount of fuel required to obtain the maximum discharge amount, thereby lowering the fuel discharge capability of the device.

Accordingly, for the conventional device 100, it is difficult to rapidly increase the fuel pressure in the common rail 112 at the start of the internal combustion engine 115, at which the fuel pressure in the common rail 112 should be rapidly increased to a predetermined value by maximizing the discharge amount of the device 100.

At high-load operation of the internal combustion engine 115, the speed of the reciprocation of the plunger 102 increases, and thus the ratio of the response lag time to the time required to introduce fuel into the plunger chamber 103 and pressurize it therein becomes comparatively large. As a result, the conventional device 100 may fail to secure a sufficient discharge amount required to meet the increase in the fuel amount injected from the injectors 113, and thus the fuel in the common rail 112 may not be kept at a predetermined pressure.

In view of the foregoing, the objective of the present invention is to provide a high-pressure fuel supply device for an internal combustion engine which has improved fuel supply capability.

SUMMARY OF THE INVENTION

The high-pressure fuel supply device of this invention is for an internal combustion engine for pressurizing fuel to a high pressure and supplying the pressurized fuel to the internal combustion engine. The device includes: a fuel pressure chamber defined by a cylinder and a plunger disposed in the cylinder so as to reciprocate in the cylinder; a fuel flow passage for pumping out fuel from a fuel tank with a pump and sending the pumped fuel to the fuel pressure chamber; a check valve disposed in the fuel flow passage for permitting flow of the fuel only to the fuel pressure chamber; a fuel supply passage associating the fuel pressure chamber with the internal combustion engine for pressing the fuel in the fuel pressure chamber pressurized by reciprocation of the plunger into the internal combustion engine; a fuel spill passage associating the fuel pressure chamber with the fuel tank; and a fuel spill valve disposed in the fuel spill passage for changing a spill amount of fuel to be returned to the fuel tank by opening and closing the fuel spill valve, so as to regulate an amount of fuel to be pressed to flow from the fuel pressure chamber to the internal combustion engine.

With the above configuration, as the plunger in the cylinder moves downward, the fuel pumped out from the fuel tank with the pump is introduced into the fuel pressure chamber via the fuel flow passage. When the fuel spill valve is in the closed state to close the fuel spill passage, the fuel introduced into the fuel pressure chamber is pressurized as the plunger moves upward. At this time, reverse flow of the fuel from the fuel pressure chamber to the fuel flow passage is blocked by the check valve. The pressurized fuel is pressed to flow to the internal combustion engine via the fuel supply passage.

When the fuel spill valve is in the open state to open the fuel spill passage, the fuel in the fuel pressure chamber spills to the fuel spill passage as the plunger moves upward to be returned to the fuel tank. This stops the fuel supply from the fuel pressure chamber to the internal combustion engine. Thus, the amount of fuel to be supplied to the internal combustion engine can be regulated by changing the time when the fuel spill valve is opened and closed.

Thus, in the high-pressure fuel supply device according to the present invention, the fuel flow passage for introducing fuel into the fuel pressure chamber and the fuel spill passage for allowing fuel to spill from the fuel pressure chamber to the fuel tank are disposed separately. With this configuration, fuel is introduced into the fuel pressure chamber via the fuel flow passage as the plunger moves downward regardless of the opening and closing of the fuel spill valve. Also, since the opening and closing operation of fuel spill valve does not block the introduction of the fuel into the fuel pressure chamber, the time when the fuel spill valve is opened or closed can be set in full consideration of the response lag.

In one embodiment of the invention, the high-pressure fuel supply device for an internal combustion engine further includes: a fuel pressure holding member disposed in the fuel spill passage for holding the fuel in the fuel spill passage at a predetermined pressure; a connecting passage for associating a portion of the fuel flow passage upstream from the check valve with a portion of the fuel spill passage between the fuel spill valve and the fuel pressure holding member, wherein the fuel spill valve has a structure where a valve body is urged to be seated on a valve seat by a negative pressure occurring in the portion of the fuel spill passage between the fuel spill valve and the fuel pressure holding member.

The portion of the fuel spill passage between the fuel spill valve and the fuel pressure holding member may be held at a negative pressure by the generation of fuel pressure pulsation. In such a case, the fuel spill valve may not open easily, resulting in lowering the operational response of the valve, or, if the valve is kept closed at subsequent strokes, the control of the fuel discharge amount may become impossible.

With the above configuration, however, since the portion of the fuel flow passage upstream from the check valve and the portion of the fuel spill passage between the fuel spill valve and the fuel pressure holding member are associated with each other via the connecting passage, fuel is supplied from the fuel flow passage to the fuel spill passage via the connecting passage by the discharge pressure of the pump. This suppresses the occurrence of a negative pressure in the fuel spill passage.

In another embodiment of the invention, a restrictor is disposed in the connecting passage for restricting an amount of flowing fuel.

With the above configuration, the amount of fuel flowing in the connecting passage is restricted with the restrictor, thereby reducing the amount of fuel to be supplied from the fuel flow passage to the fuel spill passage via the connecting passage.

In still another embodiment of the invention, the high-pressure fuel supply device for an internal combustion engine further includes: a fuel pressure holding member disposed in the fuel spill passage for holding the fuel in the fuel spill passage at a predetermined pressure; a reservoir space formed at a portion of an inner circumferential wall of the cylinder which is in continuous contact with the plunger for storing fuel which has leaked from the fuel pressure chamber;. and a connecting passage for associating the reservoir space with a portion of the fuel spill passage between the fuel spill valve and the fuel pressure holding member, wherein the fuel spill valve has a structure where a valve body is urged to be seated on a valve seat by a negative pressure occurring in the portion of the fuel spill passage between the fuel spill valve and the fuel pressure holding member.

With the above configuration, the reservoir space formed at the inner circumferential wall of the cylinder and the portion of the fuel spill passage between the fuel spill valve and the fuel pressure holding member are associated with each other via the connecting passage. Accordingly, pressurized fuel which has leaked from the fuel pressure chamber into the reservoir space is supplied to the fuel spill passage via the connecting passage, thereby suppressing the occurrence of a negative pressure in the fuel spill passage.

Thus, the invention described herein makes possible the advantage of providing a high-pressure fuel supply device for an internal combustion engine which has improved fuel supply capability.

These and other advantages of the present invention will become apparent to those skilled in the art upon reading and understanding the following detailed description with reference to the accompanying figures.

DESCRIPTION OF THE PREFERRED EMBODIMENTS

Example 1

In Example 1, the present invention is implemented as a fuel supply device for a gasoline engine for a vehicle.

Figure 1:
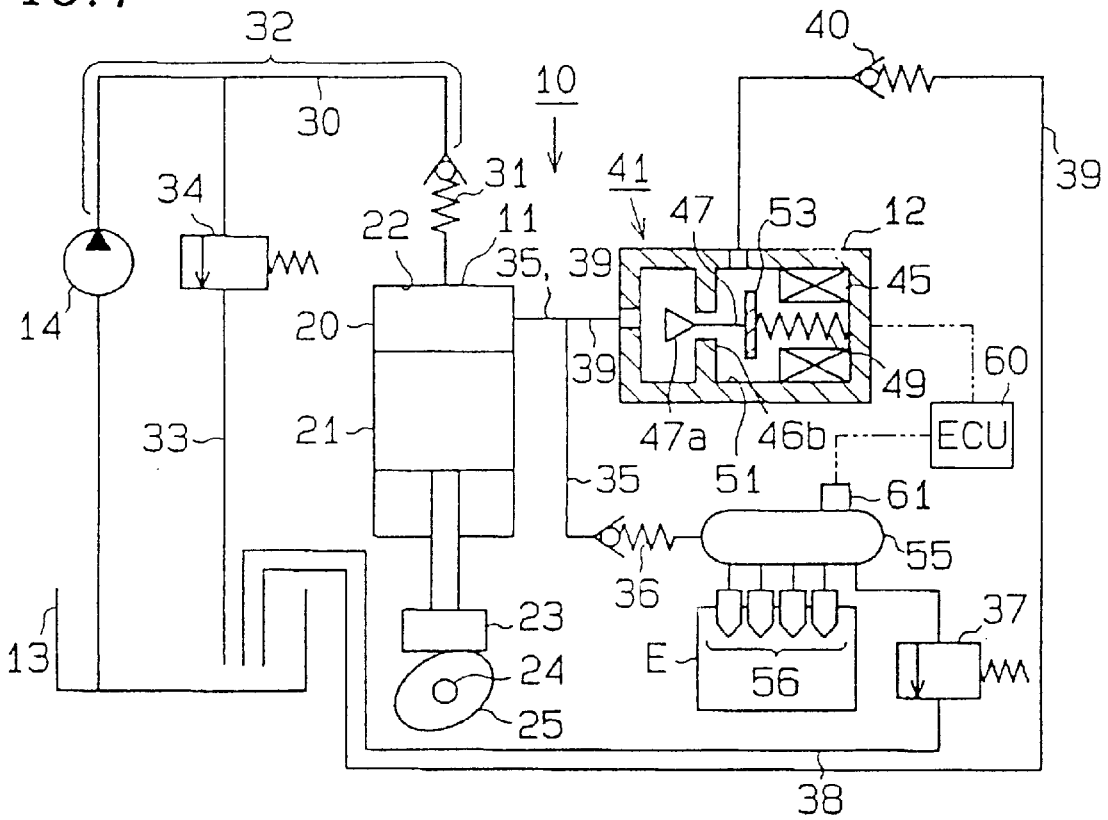
FIG. 1 is a schematic structural view of a high-pressure fuel supply device of Example 1 according to the present invention.

FIG. 1 shows a fuel supply device 10 of Example 1, which includes a high-pressure pump 11, a spill valve 41, a fuel tank 13, a low-pressure feed pump 14, and the like. The high-pressure pump 11 for pressurizing fuel includes a cylinder 20, a plunger 21 which reciprocates in the cylinder 20, and a pressure chamber 22 defined by the inner circumferential wall of the cylinder 20 and the top surface of the plunger 21.

A tappet 23 attached to the bottom of the plunger 21 (shown in the lower part of FIG. 1) is pressed against a cam 25 coupled to a crank shaft 24 of an engine E with the urging force of a spring (not shown). As the cam 25 rotates in response to the rotation of the crank shaft 24, the plunger 21 reciprocates in the cylinder 20 varying the volume of the pressure chamber 22.

The pressure chamber 22 is associated with the fuel tank 13 via a flow passage 30. The flow passage 30 is provided with a low-pressure feed pump 14 which pumps fuel from the fuel tank 13 out to the flow passage 30. The pumped fuel flows through the flow passage 30 and introduced into the pressure chamber 22 when the plunger 21 moves downward in the cylinder 20. The flow passage 30 is also provided with a check valve 31 disposed somewhere between the low-pressure feed pump 14 and the pressure chamber 22. The check valve 31 permits only the flow of fuel from the low-pressure feed pump 14 to the pressure chamber 22 in the flow passage. 30.

The portion of the flow passage 30 between the low-pressure feed pump 14 and the check valve 31 (hereinbelow, this portion is referred to as a "discharge-side flow passage 32") is also associated with the fuel tank 13 via a relief passage 33. A relief valve 34 is disposed somewhere in the relief passage 33 and opens when the fuel pressure in the discharge-side flow passage 32 increases to a predetermined value or more. With the opening of the relief valve 34, the fuel in the discharge-side flow passage 32 flows back to the fuel tank 13 via the relief passage 33. As a result, the pressure of the fuel flowing from the low-pressure feed pump 14 to the pressure chamber 22 is maintained substantially constant.

The pressure chamber 22 is associated with a fuel reservoir 55 of the engine E via a supply passage 35. The fuel reservoir 55 distributes fuel therein to a plurality of injectors 56 to be described later while keeping the fuel at a high pressure.

The plurality of injectors 56 are disposed for respective cylinders of the engine E and associated with the fuel reservoir 55 so as to receive high-pressure fuel from the fuel reservoir 55. The supply passage 35 is provided with a check valve 36 which permits only the flow of fuel from the pressure chamber 22 to the fuel reservoir 55, so as to block the fuel from flowing reversely from the fuel reservoir 55 to the pressure chamber 22.

The fuel reservoir 55 is also associated with the fuel tank 13 via a relief passage 38 which is provided with a relief valve 37 disposed on the way. The relief valve 37 opens when the fuel pressure in the fuel reservoir 55 increases to a predetermined value or more, to allow the fuel in the fuel reservoir 55 to flow back to the fuel tank 13 via the relief passage 38. This prevents the fuel pressure in the fuel reservoir 55 from becoming excessively high.

The injectors 56 open and close in response to a signal from an electronic control unit (ECU) 60 of the engine E, to start and terminate the injection of a predetermined amount of fuel into the respective cylinders of the engine E. A fuel pressure sensor 61 is disposed in the fuel reservoir 55 so as to detect the fuel pressure in the fuel reservoir 55 and output a signal corresponding to the pressure to the ECU 60.

The pressure chamber 22 is associated with the fuel tank 13 via a spill passage 39 which shares the portion thereof closer to the pressure chamber 22 with the supply passage 35. A spill valve 41 is disposed somewhere in the spill passage 39. The spill valve 41 is a normally-open solenoid valve which is activated under control of the ECU 60. A pressure adjusting valve 40 is disposed in the spill passage 39 downstream from the spill valve 41, which blocks reverse flow of the fuel from the fuel tank 13 to the spill valve 41 and opens when the fuel pressure in the spill passage 39 increases to a predetermined pressure or more.

Figure 2:
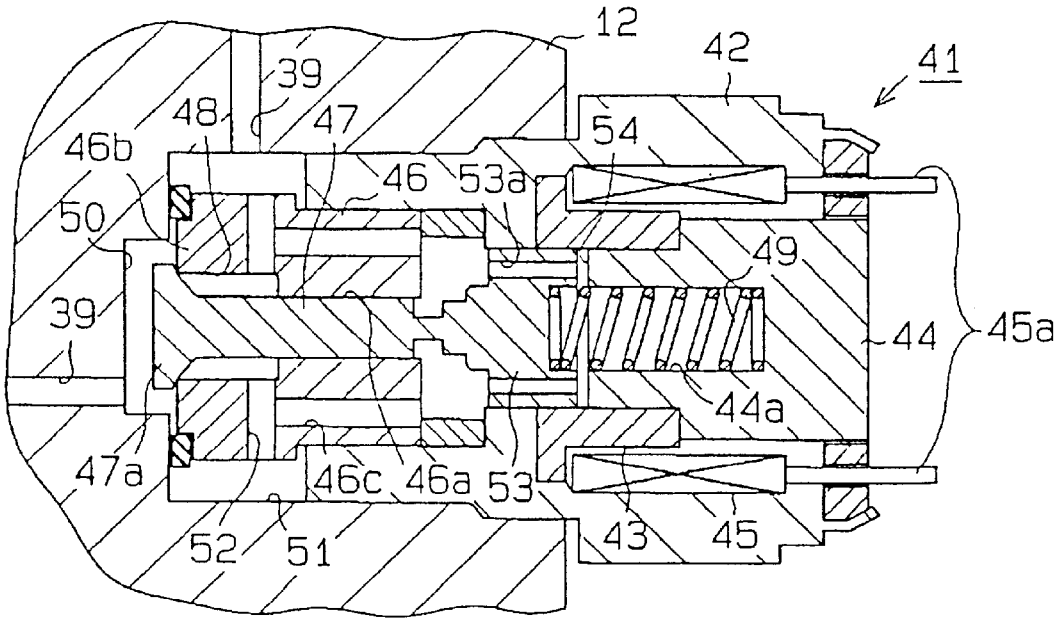
FIG. 2 is a sectional view of a spill valve of the high-pressure fuel supply device of FIG. 1.

FIG. 2 is a sectional view of the spill valve 41 (which is shown schematically in FIG. 1). Referring to FIG. 2, a housing 42 of the spill valve 41 is secured to a pump body 12 of the high-pressure pump 11. A sleeve 43 of a substantially cylindrical shape is secured to the inner wall of the housing 42, and a stator 44 is secured to the sleeve 43. The sleeve 43 is made of a resin material having a large elastic modulus.

A solenoid coil 45 of a ring shape is disposed inside the housing 42 so as to cover the outer circumference of the stator 44. The solenoid coil 45 is connected to the ECU 60 via a lead 45*a*, so that the stator 44 is excited by the activation of the solenoid coil 45 by the ECU 60.

A guide 46 of a cylindrical shape is inserted into the head portion of the housing 42 (the left side as is viewed from FIG. 2) and supported therein. A through hole 46*a* with a larger-diameter opening is formed inside the guide 46, and a valve axis 47 of a substantially cylindrical shape is movably inserted in the through hole 46*a*. The valve axis 47 has a larger-diameter head portion which constitutes a valve body 47*a*. The circumferential edge around the opening of the through hole 46*a* constitutes a valve seat 46*b* of the spill valve 41. The valve body 47*a* comes into contact with or moves away from the valve seat 46*b* as the valve axis 47 reciprocates. A ring-shaped internal spill space 48 is defined by the inner circumferential wall of the head portion of the through hole 46*a* and the outer circumferential face of the valve axis 47.

An armature 53 of a substantially disc shape is integrally formed with the valve axis 47 at the base end thereof (the right side as is viewed from FIG. 2). The armature 53 is movably supported by the housing 42 and the sleeve 43, so that the base end of the armature 53 closely faces the head of the stator 44. An insertion hole 44*a* is formed in the head portion of the stator 44 to receive and support a spring 49 therein. The armature 53 is urged by the spring 49 so that the valve body 47*a* is away from the valve seat 46*b*.

In the spill valve 41 with the above configuration, when the stator 44 is not excited, the valve body 47*a* is away from the valve seat 46*b* by the urging force of the spring 49. Thus, the spill valve 41 is normally open. When the stator 44 is excited by the solenoid coil 45, the armature 53 is attracted to the stator 44 and thus moves toward the stator 44 against the urging force of the spring 49. With this movement, the valve body 47*a* is seated on the valve seat 46*b*, to close the spill valve 41.

A fuel introduction space 50 is provided at the portion of the pump body 12 facing the head of the valve body 47*a*. The fuel introduction space 50 is associated with the pressure chamber 22 via the spill passage 39 to allow the fuel pressurized in the pressure chamber 22 to flow into the fuel introduction space 50.

A ring-shaped external spill space 51 is defined by the inner circumferential wall of the pump body 12, the outer circumferential face of the guide 46, and the head of the housing 42. The external spill space 51 and the internal spill space 48 are associated with each other via a spill bore 52 formed through the guide 46. The external spill space 51 is further associated with the fuel tank 13 through the spill passage 39 via the pressure adjusting valve 40.

The spill bore 52 is associated with a gap 54 formed between the base end of the armature 53 and the head of the stator 44 via passages 46*c* and 53*a* formed through the guide 46 and the armature 53, respectively, and the like.

Hereinbelow, the function of the fuel supply device 10 with the above configuration will be described.

When the operation of the engine E is started, the cam 25 rotates by the rotation of the crank shaft 24. This causes the plunger 21 to reciprocate upward and downward in the cylinder 20. The fuel pumped from the fuel tank 13 to the flow passage 30 by the low-pressure feed pump 14 is introduced into the pressure chamber 22 via the check valve 31 simultaneously when the plunger 21 starts the downward movement from the top dead center. At this time, the solenoid coil 45 of the spill valve 41 is not activated by the ECU 60, keeping the spill valve 41 open.

In this example, as described above, fuel is introduced into the pressure chamber 22 via the flow passage 30 provided separately from the spill passage 39. This prevents the valve body 47*a* of the spill valve 41 from blocking the flow of the fuel into the pressure chamber 22, ensuring that fuel is continuously introduced into the pressure chamber 22 throughout the downward movement of the plunger 21 from the top dead center to the bottom dead center, regardless of the opening/closing of the spill valve 41. Thus, in this example, a sufficient amount of fuel is introduced into the pressure chamber 22 without fail.

The plunger 21 then starts moving upward from the bottom dead center. In the case where the spill valve 41 is open, the fuel in the pressure chamber 22 spills out to the spill passage 39 to flow back to the fuel tank 13. Therefore, the fuel is not pressurized and thus is not pressed to flow into the fuel reservoir 55. On the contrary, when the spill valve 41 is closed, the fuel in the pressure chamber 22 is pressurized and the pressurized fuel is pressed to flow into the fuel reservoir 55 via the supply passage 35 with the opening of the check valve 36. In the fuel supply device 10 of this example, the amount of fuel pressed to flow into the fuel reservoir 55 is regulated by adjusting the time when the spill valve 41 is closed, i.e., when the solenoid coil 45 is activated by the ECU 60. The ECU 60 controls so that the fuel pressure in the fuel reservoir 55 detected by the fuel pressure sensor 61 becomes a predetermined value.

When the maximum discharge amount is desired for the fuel supply device 10, it should be ensured that the spill valve 41 has been closed when the plunger 21 starts moving upward. In this example, as described above, the closing of the spill valve 41 will not affect the introduction of the fuel into the pressure chamber 22. Accordingly, the spill valve 41 may be closed at any timing during the downward movement of the plunger 21 from the top dead center to the bottom dead center.

In this example, therefore, the activation of the solenoid coil 45 is started at an earlier timing to compensate the response lag of the spill valve 41, so as to ensure that the spill valve 41 has been closed when the plunger 21 starts moving upward. This solves the conventional problem that the fuel in the pressure chamber 22 spills to the spill passage 39 due to the delay of the switching of the spill valve 41 from opening to closing, and thus the amount of fuel supplied to the fuel reservoir 55 is reduced.

Moreover, in this example, when the maximum discharge amount is desired for the fuel supply device 10, a comparatively large control error at the activation of the spill valve 41 is permitted. This is because a variation in the time when the spill valve 41 is closed scarcely affects the introduction of fuel into the pressure chamber 22 and pressurization of the fuel since the spill valve 41 has been closed when the plunger 21 starts moving upward. Accordingly, a stable supply of fuel to the fuel reservoir 55 is ensured even if the response of the spill valve 41 varies due to the difference between individuals, the ambient temperature, the fuel temperature, and the like.

Thus, in this example, a sufficient amount of fuel introduced into the pressure chamber 22 can be supplied to the fuel reservoir 55 without spilling. This improves the fuel supply capability of the fuel supply device 10.

In this example, when the fuel pressure in the fuel reservoir 55 needs to be increased promptly as at the start of the engine E, it can be easily accomplished by keeping the spill valve 41 closed to set the maximum discharge amount. Also, when the engine E is turned to a high-load operation increasing the fuel injection amount from the injectors 56, a sufficient fuel discharge amount to meet the increase in the fuel injection amount can be secured, holding the fuel in the fuel reservoir 55 at a predetermined pressure.

In this example, with the pressure adjusting valve 40 provided in the spill passage 39 downstream from the spill valve 41, the fuel existing in the internal spill space 48, the spill bore 52, the external spill space 51, and the like is held at a predetermined pressure when the spill valve 40 is in the closed state. The predetermined pressure is normally positive. When the spill valve 41 is to be opened again, the positive pressure serves to move the valve body 47*a* away from the valve seat 46*b*, allowing the spill valve 41 to open swiftly.

Pressure pulsation is generated in the fuel existing in the pipings of the fuel supply device 10 in response to the operation of the high-pressure pump 11 and the fuel injection by the injectors 56. When the fuel pressure in the spill passage 39 temporality increases due to the pressure pulsation, the level of opening of the pressure adjusting valve 40 increases, increasing the flow of fuel passing through the pressure adjusting valve 40. As a result, the fuel pressure in the portion of the spill passage 39 between the spill valve 41 and the pressure adjusting valve 40 abruptly lowers. If the spill valve 41 is closed at the time of the above lowering of the fuel pressure, the fuel pressure in the portion of the spill passage 39 between the spill valve 41 and the pressure adjusting valve 40 may sometimes be held negative. In such a case, the valve body 47*a* is urged to seat on the valve seat 46*b* by the negative pressure, resulting in the possibility of lowering the operational response of the spill valve 41 when the spill valve 41 is opened again.

In this example, however, such lowering of the operational response can be minimized by reducing the pressure pulsation. That is, in this example, part of the fuel existing in the internal spill space 48 and the external spill space 51 is introduced into the gap 54 formed between the base end of the armature 53 and the head of the stator 44 via the passages 46*c* and 53*a* formed through the guide 46 and the armature 53, respectively, and the like. The fuel introduced into the gap 54 presses the head of the stator 44.

As the head of the stator 44 is pressed by the fuel in the gap 54, the sleeve 43 which is made of a resin material as described above resiliently transforms, allowing the stator 44 to shift in the direction of the axis of the spill valve 41 (rightward and leftward as is viewed from FIG. 2). This changes the size of the gap 54, and thus reduces the pressure pulsation. Thus, in this example, the lowering of the operational response due to pressure pulsation can be minimized, and various problems which may be caused by the lowering of the operational response can be prevented.

A magnitude ΔP1 of pressure pulsation which can be absorbed is represented by formula (1) below:

$$\Delta P1 = \frac{\Delta V}{V} K \tag{1}$$

wherein V denotes the volume of the portion of the spill passage 39 between the spill valve 41 and the pressure adjusting valve 40, i.e., the portion of the spill passage 39 where the internal pressure is held negative (including the internal spill space 48, the spill bore 52, and the external spill space 51), ΔV denotes the variation in the volume V with the shift of the stator 44, and K is the volume elastic modulus of the fuel.

Since the magnitude of the pressure pulsation generated in the spill passage 39 is less than one atmospheric pressure at maximum, it is confirmed by substitution of a certain value in formula (1) that the pressure pulsation can be absorbed if the degree of the volume variation (ΔV/V)×100 is about 0.015% or more. Thus, in this example, the pressure pulsation can be reduced without fail by appropriately selecting the resin material for the sleeve 43 so that the above degree of the volume variation can be obtained.

Furthermore, in this example, even if an abnormal state arises where the valve body 47*a* and the valve seat 46*b* stick together keeping the spill valve 41 closed, it is still possible to introduce fuel into the pressure chamber 22 and press the fuel to flow into the fuel reservoir 55, although the regulation of the fuel discharge amount is not possible.

In the conventional fuel supply device where the same passage is used for the introduction of fuel into the pressure chamber 22 and the spilling of the fuel from the pressure chamber 22, if the above abnormal state arises keeping the spill valve 41 closed, fuel will not be introduced into the pressure chamber 22. As a result, the engine E stops and thus the vehicle stops running.

In this example, however, since fuel is pressed to flow into the fuel reservoir 55 even if the above abnormal state arises in the spill valve 41, the vehicle can be at least driven to a sidetrack. Incidentally, when such an abnormal state arises in the spill valve 41, the amount of fuel pressed to flow into the fuel reservoir 55 from the pressure chamber 22 becomes maximum. This abruptly increases the fuel pressure in the fuel reservoir 55. In such a case, as described above, the excessive fuel flows back to the fuel tank 13 via the relief passage 38 by the opening of the relief valve 37, preventing the fuel pressure in the fuel reservoir 55 from increasing excessively.

Air contained in the fuel or gas such as vapor generated with a rise of the fuel temperature (hereinbelow, collectively referred to as "air") may sometimes enter the pressure chamber 22 of the high-pressure pump 11. In the case where the engine E is stopped when the fuel is in a high temperature, in particular, the amount of air entering the pressure chamber 22 tends to increase.

Figure 7:
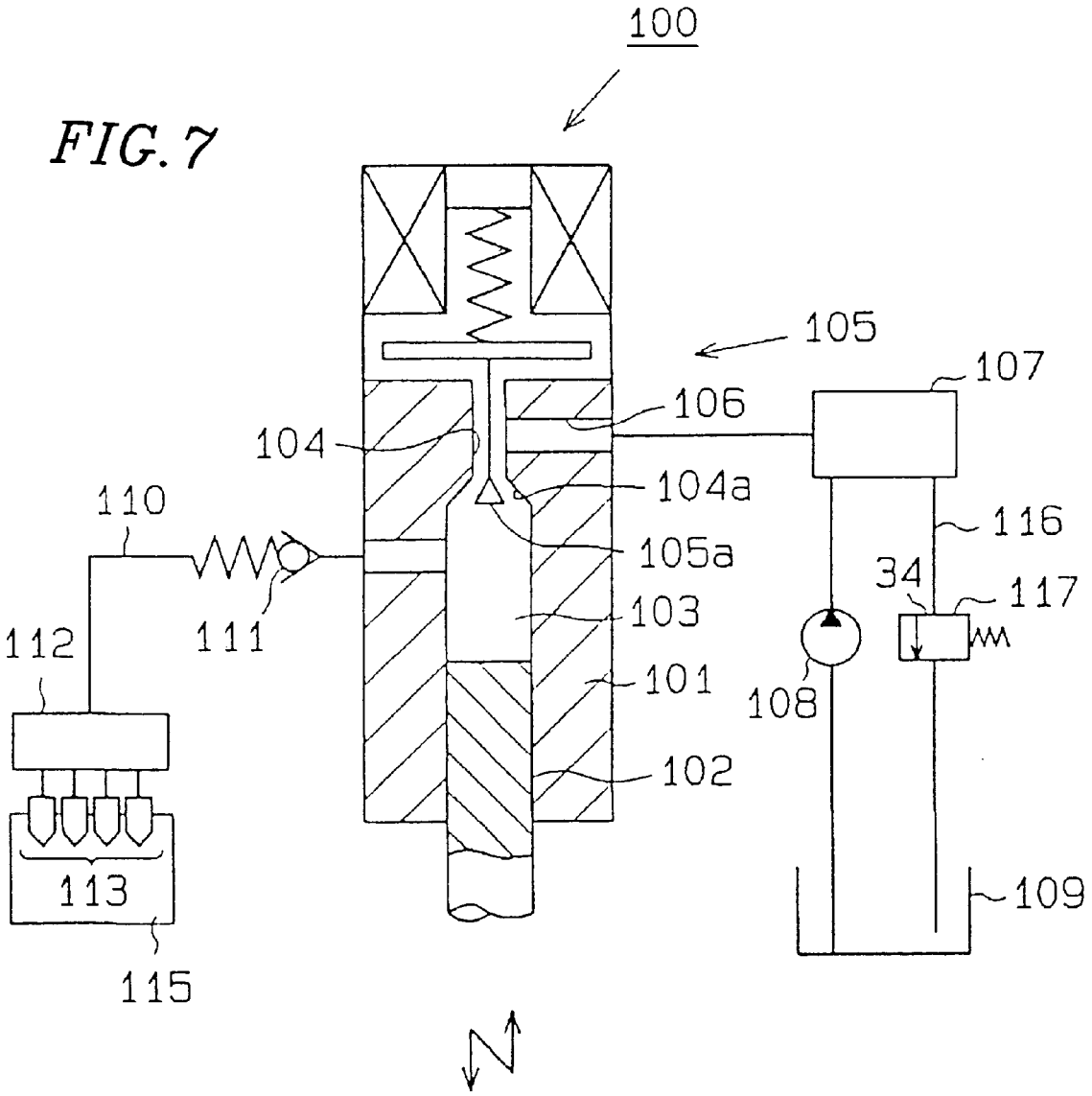
FIG. 7 is a schematic structural view of a conventional fuel supply device.

For example, in the conventional device 100 shown in FIG. 7, since the opening of the spill passage 104 is narrowed, it is difficult to drain air in the plunger chamber 103 (corresponding to the pressure chamber 22) via the spill passage 104. Moreover, when the fuel pressure in the fuel reservoir 107 increases, fuel pumped from the supply pump 108 to be introduced into the plunger chamber 103 is returned to the fuel tank 109 via the relief passage 116 without being introduced into the plunger chamber 103. This further makes it difficult to drain the air in the plunger chamber 103 via the spill passage 104, and thus the air remains in the plunger chamber 103. With the air contained in the plunger chamber 103, the amount of fuel introduced into the plunger chamber 103 reduces, and it is difficult to pressurize the fuel in the plunger chamber 103 to a predetermined value.

In this example, however, the fuel returned to the fuel tank 13 via the spill passage 39 necessarily passes through the pressure chamber 22. Most of the air in the pressure chamber 22 is therefore carried to the fuel tank 13 together with the fuel. Thus, in this example, the problem of reducing the amount of fuel introduced into the pressure chamber 22 and lowering the efficiency of the pressurization of the fuel by the high-pressure pump 11 due to air contained in the pressure chamber 22 is minimized.

Example 2

Figure 3:
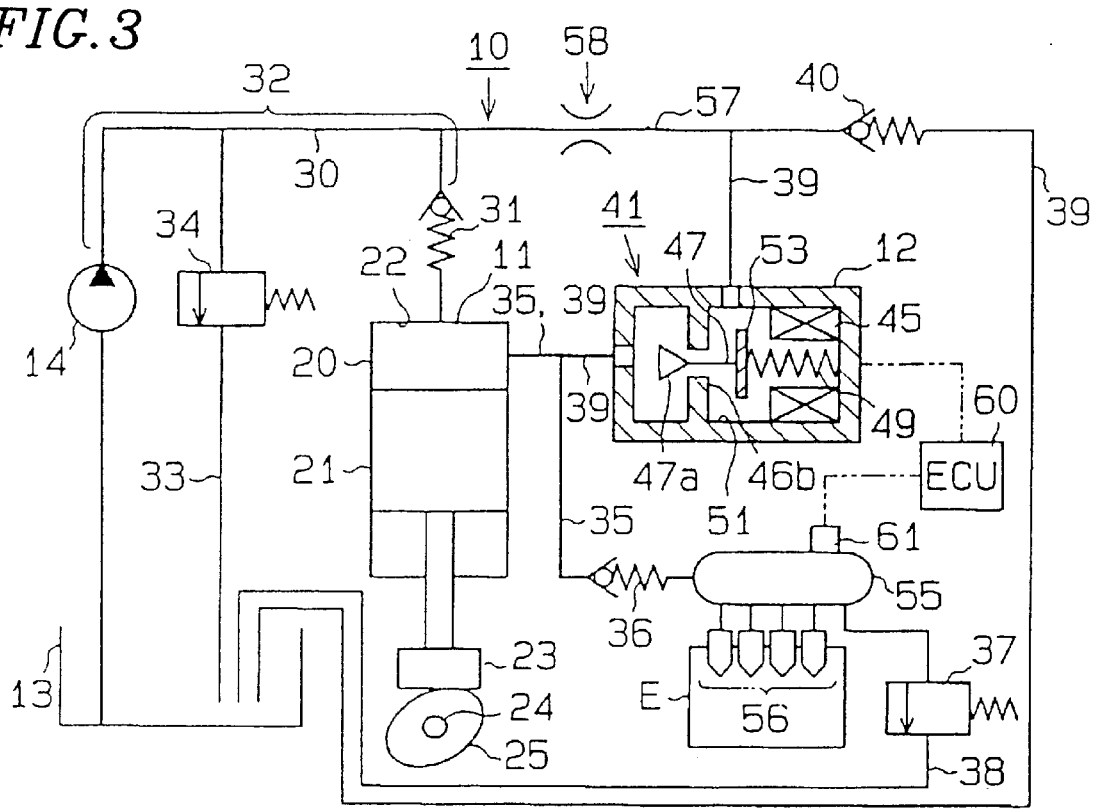
FIG. 3 is a schematic structural view of a high-pressure fuel supply device of Example 2 according to the present invention.

FIG. 3 shows a schematic configuration of a fuel supply device 10 of Example 2 according to the present invention. In this example, only the difference from Example 1 will be described. The same components as those in Example 1 are denoted by the same reference numerals, and the description thereof is omitted here.

The fuel supply device 10 of this example is different from that of Example 1 in that the discharge-side flow passage 32 and the portion of the spill passage 39 between the external spill space 51 and the pressure adjusting valve 40 are associated with each other by a pressure passage 57. The pressure passage 57 is provided to increase the pressure in the portion of the spill passage 39 between the spill valve 41 and the pressure adjusting valve 40 from a negative to a positive pressure. A restrictor 58 is formed somewhere in the pressure passage 57 to narrow the passage.

A radius r of the restrictor 58 is determined by formulae (2) and (3) below. First, a flow Q of the pressure passage 57 required to increase the negative pressure to a positive pressure is calculated.

$$Q = \frac{\Delta PV}{Kt1} \tag{2}$$

wherein ΔP denotes the pressure difference between the portion of the spill passage 39 upstream from the pressure adjusting valve 40 (the side of the spill valve 41) and the portion thereof downstream from the pressure adjusting valve 40 (the side of the fuel tank 13), V denotes the volume of the portion of the spill passage 39 between the spill valve 41 and the pressure adjusting valve 40 as described above, K denotes the volume elastic modulus of the fuel as described above, and t1 denotes the time required to increase the negative pressure to a positive pressure. In this example, t1 is set at 5 msec.

The flow Q obtained from formula (2) is substituted in formula (3) below to calculate the radius r of the restrictor 58.

$$r^2 = \frac{Q}{\sqrt[c]{\frac{2g\Delta P}{\gamma}}} \tag{3}$$

wherein c denotes the flow constant determined by the shape of the restrictor 58, g denotes the gravitational acceleration, γ denotes the liquid specific gravity of the fuel, and ΔP denotes the pressure difference as in formula (2).

Thus, the fuel supply device 10 of this example is provided with the pressure passage 57 in addition to the configuration of the device of Example 1. With this configuration, even if a negative pressure occurs in the portion of the spill passage 39 between the external spill space 51 and the pressure adjusting valve 40, the negative pressure in the spill passage 39 can be eliminated since fuel is supplied to the spill passage 39 via the pressure passage 57. As a result, the lowering of the operational response caused by the negative pressure held in the spill passage 39 as described above can be prevented.

Moreover, in this example, the radius r of the restrictor 58 is determined based on formulae (2) and (3) above. The radius r is thus set at a value necessary and sufficient in the design. More specifically, by setting the radius r as described above, the amount of fuel flowing through the pressure passage 57 can be set at an amount sufficient to eliminate the negative pressure in the spill passage 39, and flowing of excessive fuel into the spill passage 39 can be prevented. As a result, the device of this example not only prevents the occurrence of a negative pressure without fail, but also prevents an increase in the load of the low-pressure feed pump 14 which may be caused by supplying unnecessary fuel to the spill passage 39.

Furthermore, in this example, the pressure adjusting valve 40 is often kept open since fuel is supplied to the spill passage 39 via the pressure passage 57. This reduces the necessity of strictly controlling the sealing at the pressure adjusting valve 40, which is advantageous in the design.

Example 3

Figure 4:
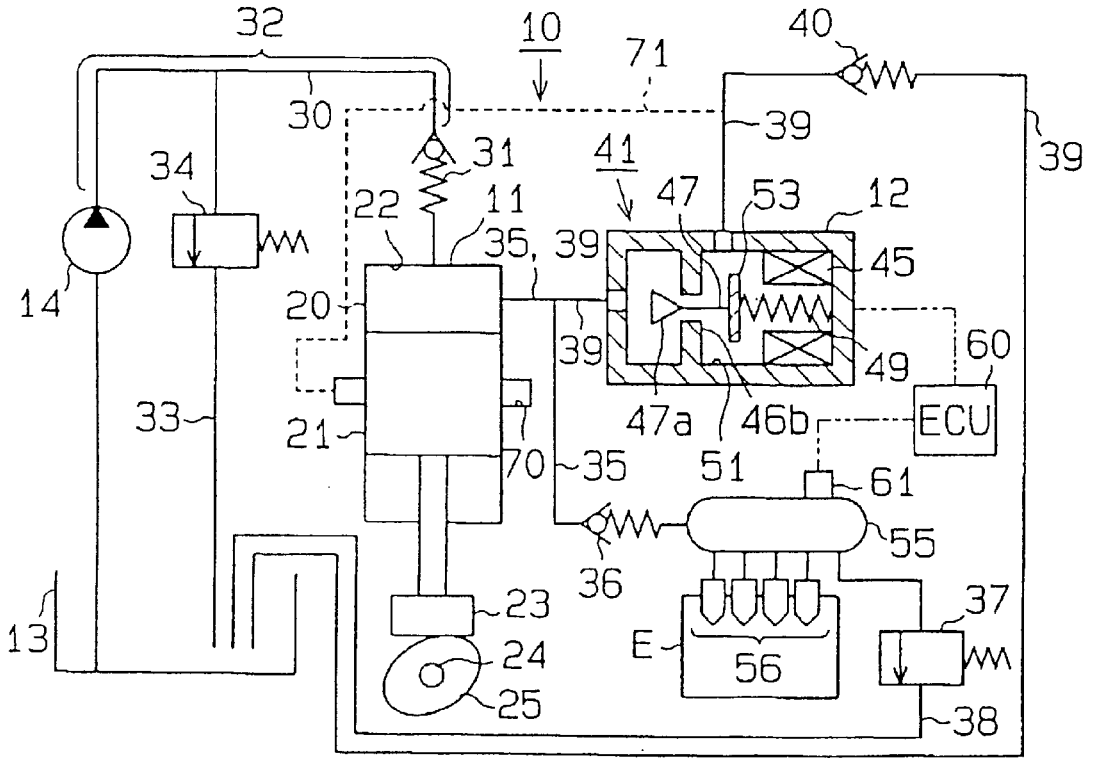
FIG. 4 is a schematic structural view of a high-pressure fuel supply device of Example 3 according to the present invention.

FIG. 4 shows a schematic configuration of a fuel supply device 10 of Example 3 according to the present invention. In this example, only the difference from Example 1 will be described. The same components as those in Example 1 are denoted by the same reference numerals, and the description thereof is omitted here.

A ring-shaped groove 70 is formed at the portion of the inner circumferential wall of the cylinder 20 located below the bottom dead center of the plunger 21, i.e., the portion which the plunger 21 is always in contact with, so as to surround the plunger 21. Part of the fuel leaking into a minute clearance (not shown) between the inner circumferential wall of the cylinder 20 and the outer circumferential face of the plunger 21 during the pressurization of the fuel in the pressure chamber 22 is guided into the ring-shaped groove 70. The ring-shaped groove 70 is associated with the portion of the spill passage 39 between the spill valve 41 and the pressure adjusting valve 40 via a leak passage 71. Thus, in this example, the negative pressure occurring in the spill passage 39 is eliminated by allowing the fuel which has leaked into the ring-shaped groove 70 to flow into the spill passage 39 via the leak passage 71.

The amount Q(t) of fuel leaking into the ring-shaped groove 70 per unit time is calculated by formula (4) below:

$$Q(t) = \frac{\pi d h^3}{12\mu L(t)} P(t) \tag{4}$$

wherein d denotes the diameter of the plunger 21, h denotes the size of the clearance between the inner circumferential wall of the cylinder 20 and the outer circumferential face of the plunger 21, $\mu$ denotes the viscosity of the fuel, L(t) denotes the distance between the ring-shaped groove 70 and the top surface of the plunger 21, and P(t) denotes the fuel pressure in the pressure chamber 22. The distance L(t) and the fuel pressure P(t) vary with time as the plunger 21 reciprocates.

By integrating the thus-calculated fuel leak flow Q(t) with the time required for one stroke of the plunger 21, a total fuel amount ΔV capable of being supplied to the spill passage 39 from the ring-shaped groove 70 via the leak passage 71 is calculated. Then, a pressure increase amount Δp in the spill passage 39 is obtained by substituting the calculated total fuel amount ΔV in formula (5) below:

$$\Delta p = \frac{\Delta V}{V} K \tag{5}$$

In this example, the distance L(t), i.e., the position of the ring-shaped groove 70 on the inner circumferential wall of the cylinder 20, is determined so that the pressure increase amount Δp is larger than the pressure difference ΔP described above, i.e., so that it is large enough to eliminate the negative pressure in the spill passage 39.

Accordingly, in this example, as in Example 2, the negative pressure can be eliminated without fail, and the lowering of the operational response of the spill valve 41 due to the negative pressure held in the spill passage 39 can be prevented.

The fuel supply devices of the above examples according to the present invention can be modified as follows. These modified examples provide substantially the same functions and effects as those described in the respective examples.

(1) In Example 2 (FIG. 3), the discharge-side flow passage 32 and the portion of the spill passage 39 between the external spill space 51 and the pressure adjusting valve 40 are associated with each other via the pressure passage 57, and the restrictor 58 is provided in the pressure passage 57.

Figure 5:
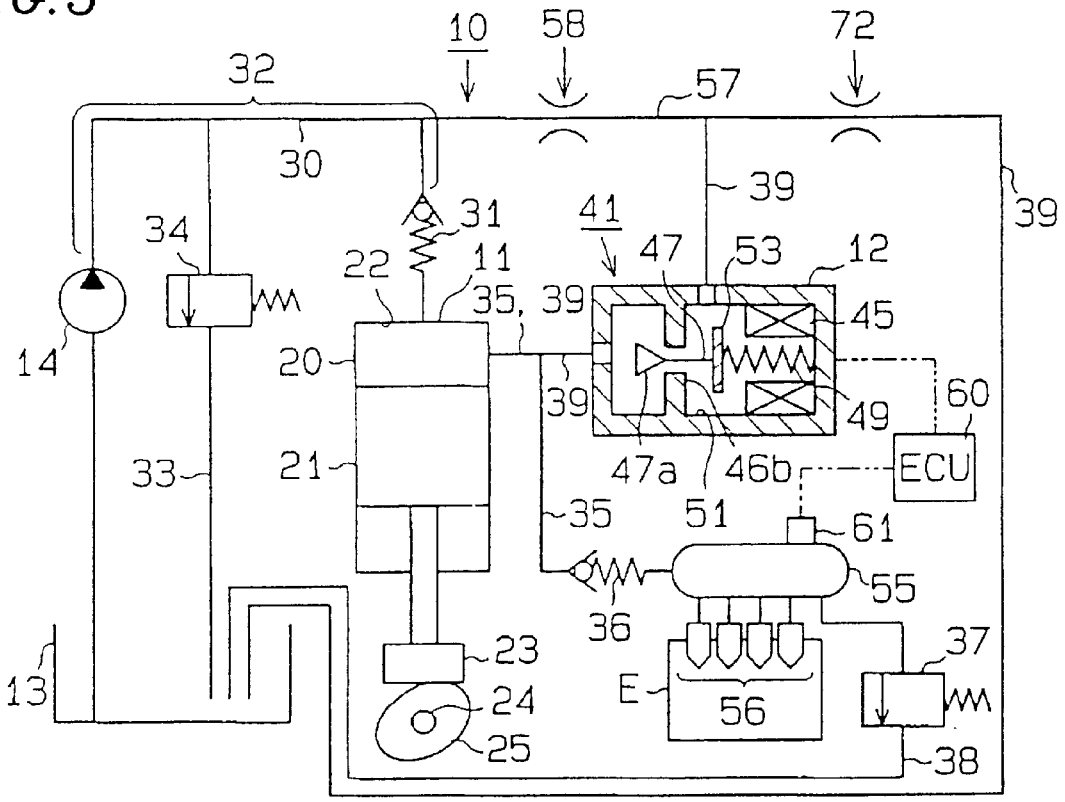
FIG. 5 is a schematic structural view of a modified example of the high-pressure fuel supply device according to the present invention.

With the above configuration, the pressure in the portion of the spill passage 39 between the spill valve 41 and the pressure adjusting valve 40 becomes a positive pressure, and the pressure adjusting valve 40 is mostly kept open. It is possible, therefore, to replace the pressure adjusting valve 40 with a restrictor 72 as shown in FIG. 5. This replacement of the pressure adjusting valve 40 with the restrictor 72 reduces the cost of the high-pressure fuel supply device 10.

(2) In Example 1, the sleeve 43 of the spill valve 41 is made of a resin material to reduce the pressure pulsation of fuel. Alternatively, the configuration as shown in FIG. 6, for example, can be used to reduce the pressure pulsation.

Figure 6:
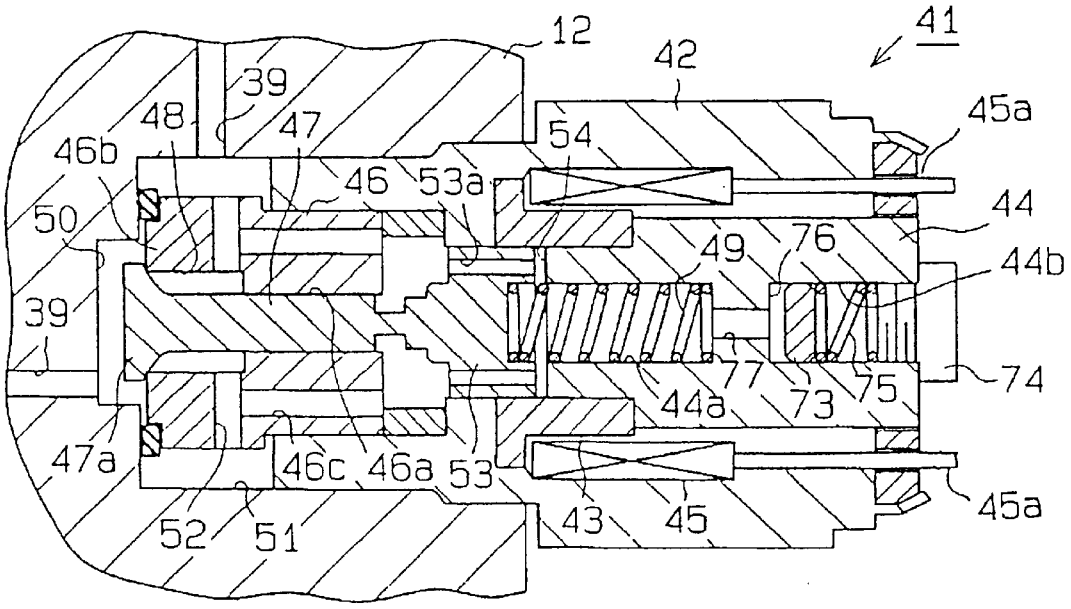
FIG. 6 is a sectional view of a spill valve of an another modified example of the high-pressure fuel supply device according to the present invention.

In FIG. 6, an insertion hole 44*b* is formed in the base end portion of the stator 44, and a movable member 73 is provided inside the insertion hole 44*b* so that the movable member 73 moves in the insertion hole 44*b* while being in close contact with the inner circumferential wall of the insertion hole 44*b*. The opening of the insertion hole 44*b* at the base end is covered with a cap 74, and a spring 75 is provided between the cap 74 and the movable member 73 so as to urge the movable member 73 toward the head of the stator 44. A pressure attenuation chamber 76 is formed as an inner space inside the head portion of the insertion hole 44*b* defined by the movable member 73. The pressure attenuation chamber 76 is associated with the inside of the insertion hole 44*a* formed in the head portion of the stator 44 via a connecting bore 77.

With the above configuration, fuel introduced into the gap 54 formed between the base end of the armature 53 and the head of the stator 44 flows through the insertion hole 44*a* and the connecting bore 77 to the pressure attenuation chamber 76. With the fuel in the pressure attenuation chamber 76, the movable member 73 moves to a position at which the force caused by the pressure of the fuel in the pressure attenuation chamber 76 and the urging force of the spring 75 are balanced against each other. In other words, the volume of the pressure attenuation chamber 76 varies depending on the fuel pressure therein. Thus, with this configuration, as in the above examples, the fuel pressure pulsation generated in the pipings of the high-pressure fuel supply device 10 can be reduced.

Alternatively, a pulsation damper may be disposed in the pipings of the high-pressure fuel supply device 10, for example, to reduce the pressure pulsation.

(3) In the above examples, the present invention is implemented as the high-pressure fuel supply device 10 for the gasoline engine E for a vehicle. Alternatively, the present invention is also applicable to a diesel engine and an engine for a stationary power supply.

(4) In the above examples, the portion of the supply passage 35 closer to the pressure chamber 22 is shared with that of the spill passage 39. Alternatively, the supply passage 35 and the spill passage 39 may be associated with the pressure chamber 22 separately.

(5) In Example 2, the restrictor 58 is provided in the pressure passage 57. Alternatively, the restrictor 58 may be omitted, or it may be replaced with a check valve which permits only the flow of fuel from the low-pressure feed pump 14 to the spill passage 39.

(6) In the above examples, the normally-open solenoid valve is used as the spill valve 41. Alternatively, a normally-closed solenoid valve may be used.

(7) In the above examples, the amount of fuel pressed to flow from the pressure chamber 22 is adjusted by changing the time when the spill valve 41 is closed. Alternatively, it may be adjusted by changing the time when the spill valve 41 is opened by setting so that the spill valve 41 is normally close before the plunger 21 starts moving upward.

Thus, the high-pressure fuel supply device according to the present invention may include: a fuel pressure holding member disposed in the fuel spill passage for holding the fuel in the fuel spill passage at a predetermined pressure; and a pressure pulsation attenuation mechanism for suppressing pressure pulsation in the portion of the fuel spill passage between the fuel spill valve and the fuel pressure holding member, wherein the fuel spill valve has a structure where the valve body is urged to be seated on the valve seat by a negative pressure in the portion of the fuel spill passage between the fuel spill valve and the fuel pressure holding member.

With the above configuration, the pressure pulsation attenuation mechanism suppresses the pressure pulsation in the portion of the fuel spill passage between the fuel spill valve and the fuel pressure holding member, and thus suppresses the inner pressure of the fuel spill passage from being held at a negative pressure. In this way, the lowering of the operational response of the fuel spill valve due to the negative pressure can be prevented.

Thus, the high-pressure fuel supply device according to the present invention has the following effects.

The fuel flow passage for introducing fuel into the fuel pressure chamber and the fuel spill passage for allowing fuel to spill from the pressure chamber to the fuel tank are disposed separately. With this configuration, fuel is introduced into the pressure chamber via the fuel flow passage as the plunger moves downward regardless of the opening and closing of the fuel spill valve, and the time when the fuel spill valve is opened or closed can be set in full consideration of the response lag. As a result, it is possible to ensure that a predetermined amount of fuel is introduced into the fuel pressure chamber and pressurized therein, improving the fuel supply capability of the high-pressure fuel supply device.

Also, according to the present invention, the portion of the fuel flow passage upstream from the check valve and the portion of the fuel spill passage between the fuel spill valve and the fuel pressure holding member are associated with each other via the connecting passage. Accordingly, the fuel pumped with the low-pressure pump is supplied to the fuel spill passage via the connecting passage, suppressing the occurrence of a negative pressure in the fuel spill passage. As a result, according to the present invention, the lowering of the operational response at the opening of the fuel spill valve can be prevented.

Moreover, according to the present invention, the restrictor is provided in the connecting passage to restrict the amount of fuel flowing therein. This reduces the amount of fuel supplied from the fuel flow passage to the fuel spill passage via the connecting passage. As a result, according to the present invention, excessive supply of fuel from the fuel flow passage to the fuel spill passage via the connecting passage is suppressed. The trouble of an increase in the load of the low-pressure pump, for example, can be prevented.

Furthermore, according to the present invention, the reservoir space formed at the inner circumferential wall of the cylinder and the portion of the fuel spill passage between the fuel spill valve and the fuel pressure holding member are associated with each other via the connecting passage. Accordingly, pressurized fuel which has leaked from the fuel pressure chamber into the reservoir space is supplied to the fuel spill passage via the connecting passage, thereby suppressing the occurrence of a negative pressure in the fuel spill passage. As a result, according to the present invention, the lowering of the operational response at the opening of the fuel spill valve can be further prevented.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A high-pressure fuel supply device for an internal combustion engine for pressurizing fuel to a high pressure and supplying the pressurized fuel to the internal combustion engine, the device comprising:

a fuel pressure chamber defined by a cylinder and a plunger disposed in the cylinder so as to reciprocate in the cylinder;

a fuel flow passage for pumping out fuel from a fuel tank with a pump and sending the pumped fuel to the fuel pressure chamber;

a check valve disposed in the fuel flow passage for permitting flow of the fuel only to the fuel pressure chamber;

a fuel supply passage associating the fuel pressure chamber with the internal combustion engine for pressing the fuel in the fuel pressure chamber pressurized by reciprocation of the plunger into the internal combustion engine;

a fuel spill passage associating the fuel pressure chamber with the fuel tank;

a fuel spill valve disposed in the fuel spill passage for changing a spill amount of fuel to be returned from the fuel pressure chamber to the fuel tank via the fuel spill passage by opening and closing the fuel spill valve, so as to regulate an amount of fuel to be pressed to flow from the fuel pressure chamber to the internal combustion engine;

a fuel pressure holding member disposed in the fuel spill passage for holding the fuel in the fuel spill passage at a predetermined pressure; and a connecting passage for associating a portion of the fuel flow passage upstream from the check valve with a portion of the fuel spill passage between the fuel spill valve and the fuel pressure holding member, wherein the fuel spill valve has a structure where a valve body is urged to be seated on a valve seat by a negative pressure occurring in the portion of the fuel spill passage between the fuel spill valve and the fuel pressure holding member.

2. A high-pressure fuel supply device for an internal combustion engine according to claim 1, wherein a restrictor is disposed in the connecting passage for restricting an amount of flowing fuel.

3. A high-pressure fuel supply device for an internal combustion engine for pressurizing fuel to a high pressure and supplying the pressurized fuel to the internal combustion engine, the device comprising:

a fuel pressure chamber defined by a cylinder and a plunger disposed in the cylinder so as to reciprocate in the cylinder;

a fuel flow passage for pumping out fuel from a fuel tank with a pump and sending the pumped fuel to the fuel pressure chamber;

a check valve disposed in the fuel flow passage for permitting flow of the fuel only to the fuel pressure chamber;

a fuel supply passage associating the fuel pressure chamber with the internal combustion engine for pressing the fuel in the fuel pressure chamber pressurized by reciprocation of the plunger into the internal combustion engine;

a fuel spill passage associating the fuel pressure chamber with the fuel tank;

a fuel spill valve disposed in the fuel spill passage for changing a spill amount of fuel to be returned from the fuel pressure chamber to the fuel tank via the fuel spill passage by opening and closing the fuel spill valve, so as to regulate an amount of fuel to be pressed to flow from the fuel pressure chamber to the internal combustion engine;

a fuel pressure holding member disposed in the fuel spill passage for holding the fuel in the fuel spill passage at a predetermined pressure;

a reservoir space formed at a portion of an inner circumferential wall of the cylinder which is in continuous contact with the plunger for storing fuel which has leaked from the fuel pressure chamber; and a connecting passage for associating the reservoir space with a portion of the fuel spill passage between the fuel spill valve and the fuel pressure holding member, wherein the fuel spill valve has a structure where a valve body is urged to be seated on a valve seat by a negative pressure occurring in the portion of the fuel spill passage between the fuel spill valve and the fuel pressure holding member.

* * * * *